US007207687B1

(12) United States Patent
Reilly

(10) Patent No.: US 7,207,687 B1
(45) Date of Patent: Apr. 24, 2007

(54) ILLUMINATED DEVICE

(76) Inventor: Kevin Reilly, 6222 Bullard Dr., Oakland, CA (US) 94611

( * ) Notice: Subject to any disclaimer, the term of this patent is extended or adjusted under 35 U.S.C. 154(b) by 0 days.

(21) Appl. No.: 10/744,384

(22) Filed: Dec. 24, 2003

Related U.S. Application Data

(63) Continuation-in-part of application No. 10/635,513, filed on Aug. 7, 2003, now abandoned.

(51) Int. Cl.
*F21V 33/00* (2006.01)

(52) U.S. Cl. ..... 362/95; 362/84; 362/34

(58) Field of Classification Search ..... 362/84, 362/156, 95; 428/690, 917, 156
See application file for complete search history.

(56) References Cited

U.S. PATENT DOCUMENTS

| | | | | |
|---|---|---|---|---|
| 1,342,778 | A * | 6/1920 | Thorne | 250/462.1 |
| 6,364,498 | B1 * | 4/2002 | Burbank | 362/84 |
| 6,547,411 | B1 * | 4/2003 | Dornbusch | 362/95 |
| 6,848,808 | B2 * | 2/2005 | Guerrieri | 362/156 |
| 2003/0211288 | A1 * | 11/2003 | Schottland | 428/156 |

* cited by examiner

*Primary Examiner*—Sandra O'Shea
*Assistant Examiner*—Anabel Ton
(74) *Attorney, Agent, or Firm*—Theodore J. Bielen, Jr.

(57) ABSTRACT

An illuminated article utilizing a base member having an outer surface. A plurality of luminescent bodies are embedded in the base member for exposure of the same at the outer surface of the base member. The article may be formed into various shapes to illuminate operable members such as light switches, electrical plugs, keyholes, and the like.

1 Claim, 5 Drawing Sheets

ILLUMINATED DEVICE

CROSS-REFERENCE TO RELATED APPLICATIONS

The present application is a Continuation-in-Part of U.S. patent application Ser. No. 10/635,513; filed 7 Aug. 2003 now abandoned.

BACKGROUND OF THE INVENTION

The present invention relates to a novel and useful illumination system.

It is often necessary to illuminate controls and other articles which access spaces. For example, key holders, switch plates, number plates, and the like are difficult to see in darkened spaces and during the nighttime.

In the past, persons accessing such articles have been forced to carry flashlights or install permanent lighting in or about the articles to be operated in the dark. Although satisfactory in providing visibility to such articles, these methods are expensive or cumbersome.

The other systems have been proposed such as those shown in U.S. Pat. Nos. 1,385,300, 1,522,169, 2,032,540, and 2,515,820 which utilize luminous coatings or paints to illuminate switches.

U.S. Pat. Nos. 2,085,331, 2,188,264, 2,617,290, 2,658,151, and 2,729,749 describe luminous coatings which are used in conjunction with locks and keyholes.

U.S. Pat. No. 284,163 illustrates luminous sign which employs luminous paint about the peripheral area.

U.S. Pat. No. 292,090 shows a luminous guide plate which employs portions which have been coated with a luminous paint or composition to provide lighting in a darkened area.

U.S. Pat. No. 2,910,792 teaches a highway sign which employs reflective beads that are laminated to a portion of the sign by a transparent plate.

An illuminated article which may be formed easily into numerous articles for use in darkened areas would be a notable advance in the household arts.

BRIEF SUMMARY OF THE INVENTION

In accordance with the present invention a novel and useful illuminated article is herein provided.

The article of the present invention utilizes a base member having an outer surface. The base member may be formed into any shape and is particularly useful when employed constructed in the form of a switch plate, key sleeve identifier, a number plate, a lock collar, and the like, although the present invention is not deemed to be limited to these structures.

The base member is preferably constructed of a polymeric material which may be molded or formed into the desired article quickly and easily.

A plurality of luminescent bodies are embedded in the base member. Such luminescent bodies are dispersed through the base member in order to provide exposure of a plurality of luminescent bodies at the outer surface of the base member. In this manner, when the base member is formed into a useful article, such useful article will provide illumination in a darkened environment.

In certain embodiments, a layer of adhesive material or magnetic material may be connected to the outer surface of the base member to allow the article formed from the base member to be permanently applied or mounted temporarily to provide illumination. For example, when the article of the present invention is formed into a lock collar, such collar may be placed around a door lock to allow the user to see a keyhole at night. In addition the base member of the present invention may be formed around a light switch operator and be affixed to the light switch placed via an adhesive layer.

Other aspects of the present invention may externalize in a device for illuminating a light switch by the use of at least one luminescent cap. The cap may be supported by a projection held to the light switch cover by the light switch fasteners. An illuminated cover may be press fitted, or otherwise held to the projection to provide illumination to the light switch operator.

Further, the present invention may take the form of a luminescent sleeve which may be slipped over and held to a light switch operator, a building number identifier, a letter denoting a name and the like.

In addition an illuminating article may be found in the present invention which is capable of adhering to a surface for lighting the same.

It may be apparent that a novel and useful illuminated article has been hereinabove described.

It is therefore an object of the present invention to provide an illuminated article which may take a multiplicity of forms to provide illumination to a person performing operation on a mechanism of some sort.

Another object of the present invention is to provide an illuminated article which is relatively simple and easy to manufacture.

A further object of the present invention is to provide an illuminated article which may be permanently or temporarily mounted in the vicinity of an object which requires illumination.

Yet another object of the present is to provide an illuminated article which utilizes luminescent material in the form of pellets which may be dispersed through a base member to provide illumination at the surface of the base member.

A further object of the present invention is to provide an illuminated article which utilizes luminescent bodies which provide illumination to an object in a choice of colors.

The invention possesses other objects and advantages especially as concerns particular characteristics and features thereof which will become apparent as the specification continues.

Figure 1:
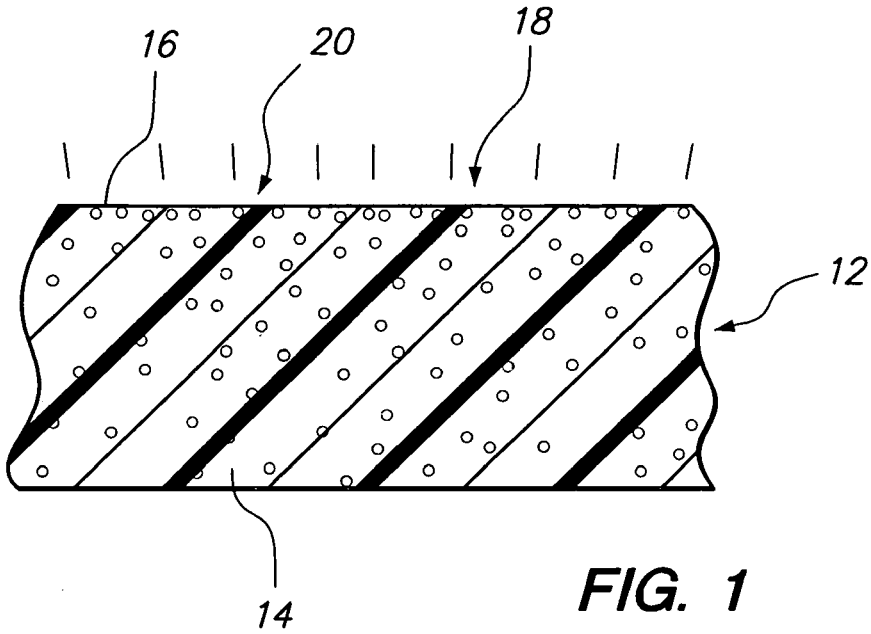
FIG. 1 is a microscopic sectional view of a portion of the base member of the present invention.

For a better understanding of the invention reference is made to the following detailed description of the preferred embodiments thereof which should be taken in conjunction with the prior described drawings.

DETAILED DESCRIPTION OF THE PREFERRED EMBODIMENTS OF THE INVENTION

Various aspects of the present invention will evolve from the following detailed description of the preferred embodiments thereof which should be taken in combination with the heretofore-delineated drawings.

The invention as a whole is shown in the drawings by reference character 10 followed by an upper case letter to denote various embodiments of the same. Article 10 includes as one of its elements a base member 12. Base member 12 is generally formed of a polymeric of plastic material such as polypropylene, polyethylene, ethylene vinyl acetate, polyvinyl chloride, and the like. Such polymeric materials are easily molded for formation into articles of various configurations by an injection molding process. As shown in FIGS. 3–6, articles 10A, 10B, and 10C are depicted in the form of a lock collar, switch plate, and an outlet plate a key sleeve identifier, respectively. Other similar articles may be embedded in base member 12. Base member 12, depicted in FIGS. 1 and 2 microscopically, include a body portion 14 having an outer surface 16.

Also, included in articles 10A, 10B, and 10C is a plurality of luminescent bodies or pellets 18. Pellets 18 are luminescent such as ones available under the Trademark Proglow, from the Proglow Manufacturing Company in Huntington Beach, Calif. Plurality of pellets 18 are maintained in such form throughout the molding process of articles 10A, 10B, or 10C. In any case, outer surface 16 of base 12 includes a plurality of luminescent pellets 18 that are exposed for visibility. Such surface pellets 20 provide illumination in the form of a glow which is illustrated in FIGS. 1–6. The glow may take various colors by the choice of pellets 18. Such glow is continuously produced although outer surface 16 wears, since pellets 28 are located throughout base member 12.

Figure 2:
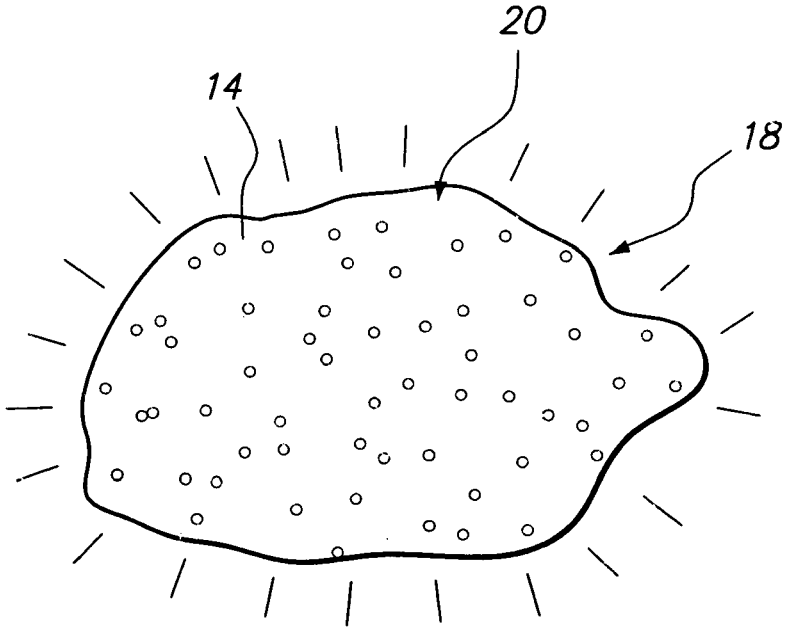
FIG. 2 is a top plan view of a microscopic rendition of the base member of the present invention.
Figure 3:
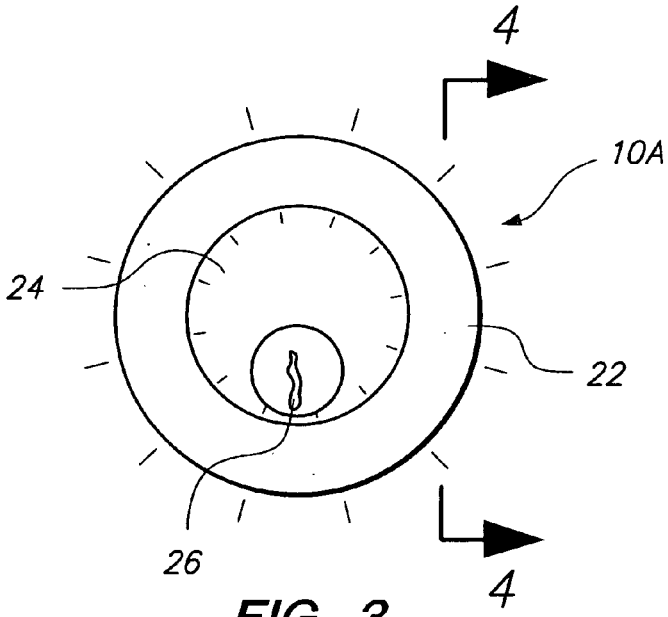
FIG. 3 is a front elevational view of a first embodiment of the article of the present invention.
Figure 4:
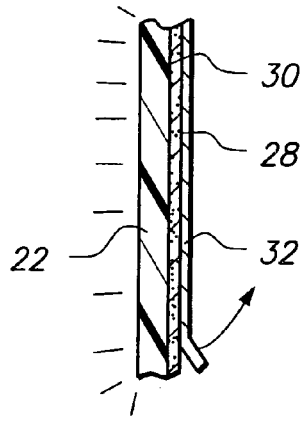
FIG. 4 is a sectional view taken along line 4—4 of FIG. 3.

Turning to FIGS. 3–6, it may be observed that articles 10A, 10B, and 10C all produce illumination and include the microscopic structure depicted in FIGS. 1 and 2. FIG. 3 shows a lock collar 22 which surrounds a lock cylinder 24 containing a keyhole 26. Lock collar 22 may be permanently connected to lock cylinder 24 or may be temporarily placed in the position shown in FIG. 3. FIG. 4 illustrates a typical structure for lock collar 22 in which an adhesive layer 28 is fixed to surface 30 of lock collar 22. Release paper 32 protects adhesive layer 28 until use when paper layer 32 is removed. Adhesive layer 22 may be substituted by a magnetic strip to allow article 10A to be placed on a metallic surface in a temporary fashion.

Light switch 34 and electrical outlet 36 are illuminated by plates 38 and 40, respectively. Plates 38 and 40 have been constructed in the same manner as lock collar 22. Plates 38 and 40 are fastened to electrical boxes, not shown, by conventional means such as fasteners.

Figure 7:
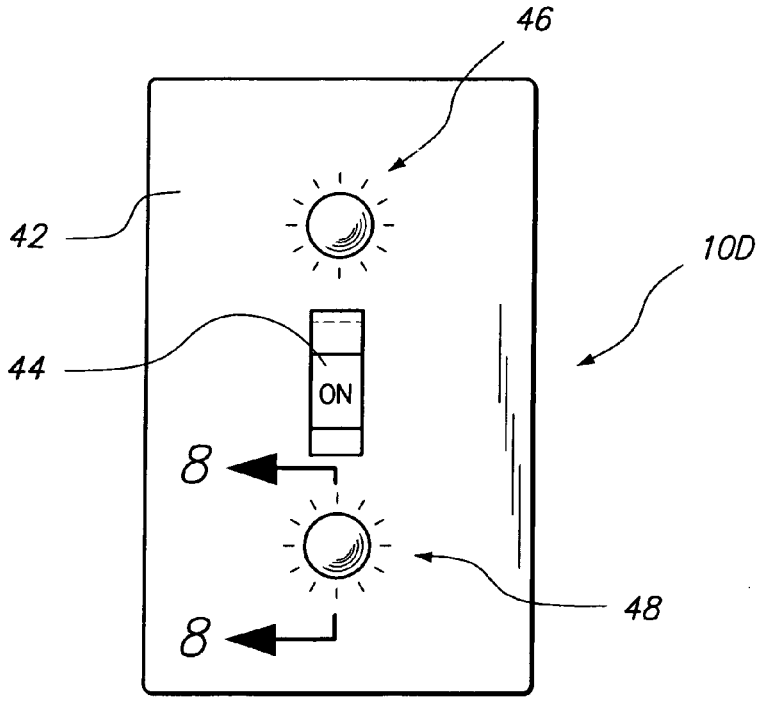
FIG. 7 is a top plan view of a fourth embodiment of the present invention.
Figure 8:
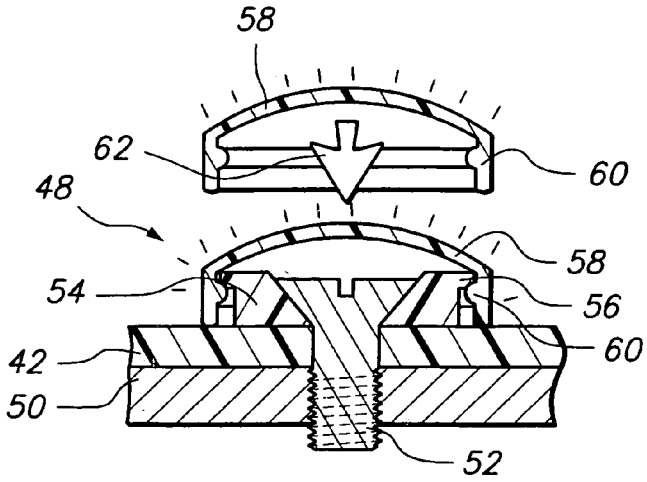
FIG. 8 is a sectional view taken along line 8—8 of the present invention.

With reference to FIGS. 7 and 8, another embodiment 10D is shown. Embodiment 10D is employed with a switch plate 42 which includes an operator 44 for controlling an electrical items such as a motor, lamp, audio device, and the like. In this regard, illuminated caps 46 and 48, formed of a material similar to base member 12, are depicted and illustrated as emanating light to operator 44. FIG. 8 details the construction of exemplary illuminated cap 48 in which switch plate 42 is depicted in relation to switch box flange 50 and fastener 52, depicted in the form of a flat head machine screw. Illuminated cap 48 includes a base projection which is held to plate 42 by machine screw 52. Base projection 54 includes a ring flange 56. Illuminated cover 58 is somewhat flexible and snaps over flange 56 and is held in place by an extension in the form of an annulus 60. It should be noted that FIG. 8 depicts illuminated cover 58 in two positions, before and after mating with base projection 54. Directional arrow 62 shows the direction of movement of illuminated cover 58 to mate, or snap-on, the same with projection 54.

Figure 9:
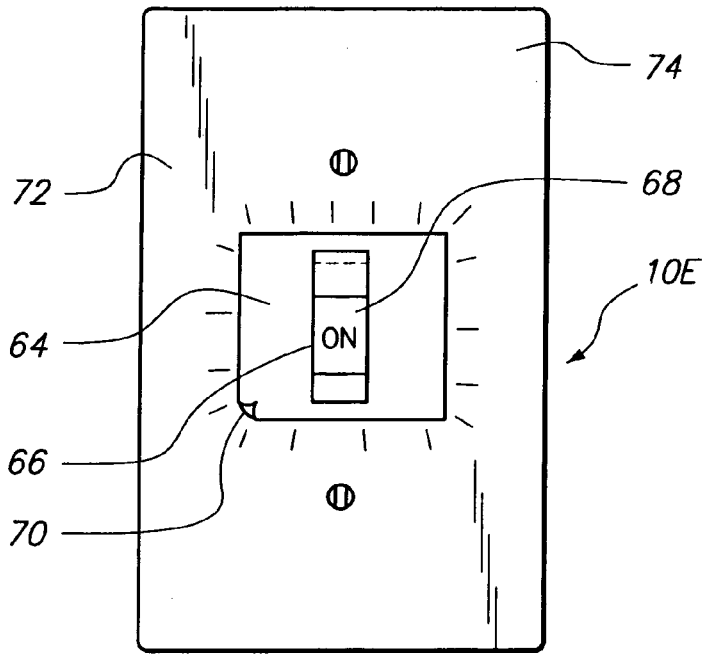
FIG. 9 is a top plan view of a fifth embodiment of the present invention.

Turning to FIG. 9, another embodiment 10E of the present invention is depicted. Embodiment 10E includes a flat illuminated sheet 64 fashioned from the same material as base member 12. Sheet 64 includes an open area 66 which allows sheet 64 to be placed over switch operator 68. An adhesive layer 70 permits sheet 64 to be firmly mounted to the top surface 72 of cover plate 74.

Figure 10:
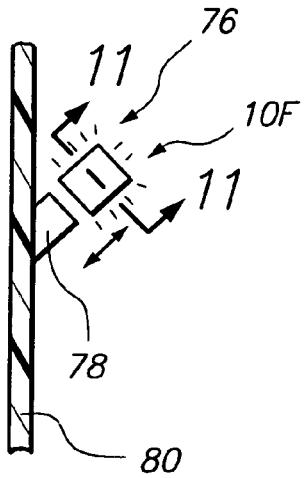
FIG. 10 is a side elevational view of a sixth embodiment of the present invention with a mounting plate depicted in cross-section.

Referencing now FIG. 10, another embodiment 10F of the present invention is shown. Device 10F takes the form of a sleeve 76 formed of the material of base member 12. Thus, sleeve 76 is illuminated. Sleeve 76 fits over operator 78 of a typical switch, similar to operator 68 of FIG. 9. Operator 78 extends from switch plate 80.

Figure 11:
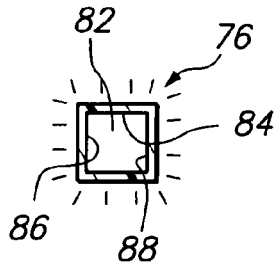
FIG. 11 is a sectional view taken along line 11—11 of FIG. 10.

With reference to FIG. 11, it may be apparent that operator 76 includes a chamber 83 formed by an inner surface 84. Adhesive layers 86 and 88 line at least a portion of inner surface 84 to allow fixation of sleeve 76 to operator 78. It should be noted that sleeve 76 may be formed into various configurations to adhere to building numbers, building sign letters, and the like for the purpose of illuminating the same in darkened conditions.

Figure 12:
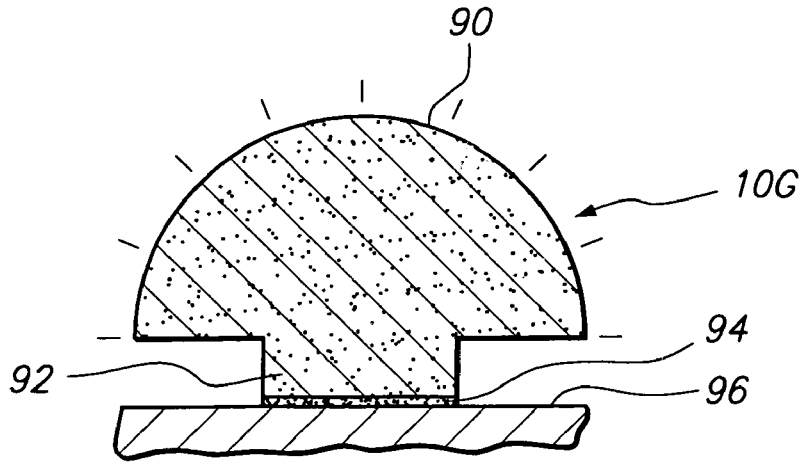
FIG. 12 is a sectional view of a seventh embodiment of the present invention adhering to a surface.
Figure 13:
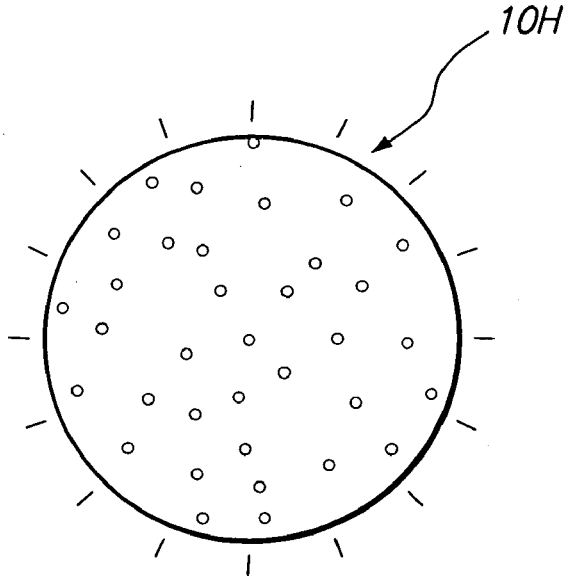
FIG. 13 is a top plan view of an eighth embodiment of the present invention.
Figure 14:
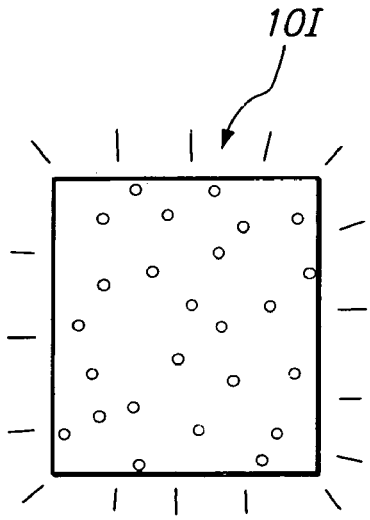
FIG. 14 is a top plan view of a ninth embodiment of the present invention.

Viewing now FIG. 12, it may be seen that another embodiment 10G of the present invention is illustrated. Article 10F takes the form of a dome-shaped object formed of the illuminating material article 10A. Light emanates from curved surface 90 to provide an even luminous distribution. Optional neck portion 92 includes an adhesive layer 94 which fixes article 106 to a surface 96. FIGS. 13 and 14 depict cylindrical and rectangular solid embodiments 10H and 10I which are constructed of the same material as article 10G and are affixed to a surface using an adhesive layer 94 of article 10G.

Figure 5:
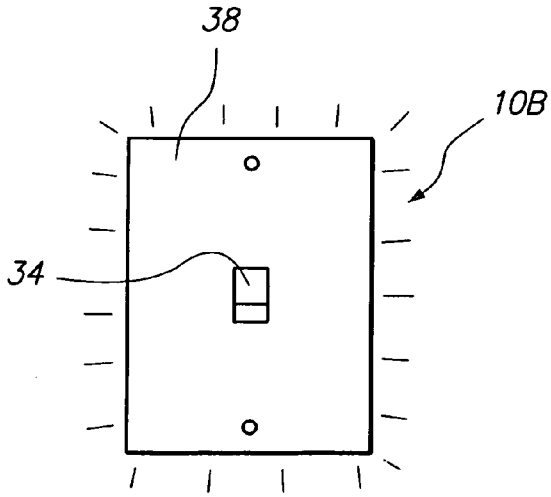
FIG. 5 is a front elevational view of a second embodiment of the article of the present invention.
Figure 6:
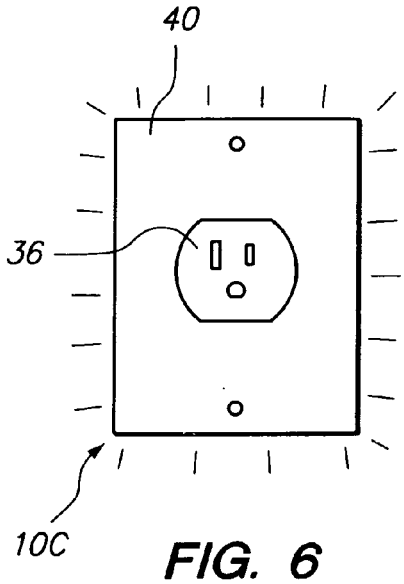
FIG. 6 is a front elevational view of a third embodiment of the article of the present invention.

In operation, the user either permanently or temporarily fastens an article 10A–10F, next to or on an object which requires illumination and darkened areas. The combination of base member 12 and plurality of luminescent pellets 18 provides a continuous glow which allows the user to perform the necessary functions with respect to such objects. For example, keyhole 26 of FIG. 3 is accessible. Also, light switch 34 and outlet 36, FIGS. 5 and 6 are available for operation. The caps 46 and 48, sheet 64 or sleeve 76, formed with the same material as base member 12 and also operate to illuminate objects.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. An illuminated article for use in conjunction with a fastener and a switch plate, the fastener engaging the switch plate, comprising:

a. a base member, having a periphery said base member being held by said fastener; and b. a cap, said cap possessing an outer surface, said cap mating with said periphery of said base member and overlying the fastener, said cap including a plurality of luminescent bodies, said luminescent bodies being embedded in said cap for exposure of said plurality of luminescent bodies at said outer surface of said cap, said cap overlying a portion of the switch plate to illuminate the switch plate.

* * * * *